United States Patent [19]

Ohkumo et al.

[11] Patent Number: 4,989,562

[45] Date of Patent: Feb. 5, 1991

[54] TROUBLE DETECTOR SYSTEM FOR AN INTAKE SYSTEM OF AN AUTOMOTIVE ENGINE

[75] Inventors: Hiroya Ohkumo; Shuji Miyama, both of Tokyo, Japan

[73] Assignee: Fuji Jukogyo Kabushiki Kaisha, Tokyo, Japan

[21] Appl. No.: 300,108

[22] Filed: Jan. 18, 1989

[30] Foreign Application Priority Data

Feb. 16, 1988 [JP] Japan ..... 63-033200

[51] Int. Cl.[5] ..... F02B 77/00

[52] U.S. Cl. ..... 123/198 D; 123/198 DB; 123/359; 123/479

[58] Field of Search ..... 123/198 D, 198 DB, 359, 123/479

[56] References Cited

U.S. PATENT DOCUMENTS 4,736,719 4/1988 Francia et al. ..... 123/198 DB
4,780,826 10/1988 Nakano et al. ..... 123/479

FOREIGN PATENT DOCUMENTS 214632 12/1983 Japan .
29749 2/1984 Japan ..... 123/479
2013837 2/1983 United Kingdom ..... 123/479

*Primary Examiner*—Noah P. Kamen
*Attorney, Agent, or Firm*—Martin A. Farber

[57] ABSTRACT

A plurality of reference pressures for pressure in an intake passage of the engine is stored in a memory so as to be derived in accordance with speed of the engine and opening degree of a throttle valve of the engine. A reference pressure is derived from the memory in accordance with the engine speed and the corrected opening degree. The pressure in an intake pipe is compared with the reference pressure. A fail-safe signal is generated when the intake pipe pressure is higher than the reference pressure. In response to the fail-safe signal, the fuel supply for the engine is cut off when the engine speed is higher than a predetermined speed.

6 Claims, 5 Drawing Sheets

CRANKANGLE SENSOR
9
COOLANT TEMPERATURE SENSOR
2
THROTTLE POSITION SENSOR
5
PRESSURE SENSOR
12
ENGINE SPEED CALCULATOR
81
ISC VALVE OPENING DEGREE CALCULATOR
80
ISC VALVE OPENING AREA CALCULATOR
82
SQ
THROTTLE OPENING DEGREE CORRECTING CALCULATOR
83
THR
THR*
Ne
REFERENCE PRESSURE CALCULATOR
84
COMPARATOR
86
ENGINE SPEED COMPARATOR
85
FUEL INJECTION CUT-OFF SECTION
87
7
3

TROUBLE DETECTOR SYSTEM FOR AN INTAKE SYSTEM OF AN AUTOMOTIVE ENGINE

BACKGROUND OF THE INVENTION

The present invention relates to a system for detecting troubles in an intake system of an automotive engine.

A fuel injection system, in which a basic fuel injection quantity is determined in accordance with pressure in an intake pipe and speed of the engine, is used for automobiles. In such a system, if trouble occurs in the intake pipe, such as a blind cap comming out on the intake system downstream of a throttle valve caused by backfiring of the engine, the air is induced in the intake pipe passing through a hole for the blind cap without passing through the throttle valve. The pressure in the intake pipe rises with the induced air. As a result, the fuel injection system operates so as to increase the basic fuel injection quantity in accordance with the high intake pipe pressure, which causes an abnormal increase of the speed of the engine regardless of the intention of the driver.

Japanese Patent Application Laid-Open No. 58-214632 discloses a system for solving such a problem. The system stores reference data of intake pipe pressure determined by the opening degree of the throttle valve and the engine speed. Detected intake pipe pressure is compared with a stored reference pressure. If the detected pressure is higher than the reference pressure, the basic fuel injection quantity is fixed to a predetermined value, thereby preventing an abnormal increase in the engine speed.

However, in the system, when an abnormally large amount of intake air flows in the intake passage, the air-fuel mixture becomes lean, because the basic fuel injection quantity is set at the predetermined value. If the mixture becomes extremely lean, misfiring of the engine occurs. Frequent misfiring cause an abnormal rise in the temperature of the exhaust gas which can break the exhaust system and a catalytic converter in the exhaust pipe.

SUMMARY OF THE INVENTION

The object of the present invention is to provide a system which may solve the above-described problems in the conventional fuel injection system.

In the system of the present invention, the engine speed is prevented from becoming excessively high by cutting off the fuel when an abnormality is detected in the intake system.

According to the present invention, there is provided a system for detecting trouble in an intake system of an engine having a throttle valve, comprising a pressure sensor for detecting pressure in an intake passage of the engine, an engine speed detector for detecting the speed of the engine, a throttle position sensor for detecting the opening degree of the throttle valve, a memory storing a plurality of reference values for a parameter selected from the pressures in an intake passage of the engine, the opening degree of the throttle valve and the engine speed, arranged to be derived in accordance with parameters other than the selected parameter, reference means for deriving a reference value from the memory in accordance with the non-selected, detected parameters, comparator means for comparing a value detected by the sensor for the selected parameter with the derived reference value, and for producing a fail-safe signal when the detected value is higher than the derived reference value, detector means responsive to the fail-safe signal for producing an engine speed reduction signal, fuel cut-off means responsive to the engine speed reduction signal for cutting off the fuel supply.

In an aspect of the invention, the selected parameter is the pressure in the intake passage.

The other objects and features of this invention will become understood from the following description with reference to the accompanying drawings.

DETAILED DESCRIPTION OF THE PREFERRED EMBODIMENT

Figure 1:
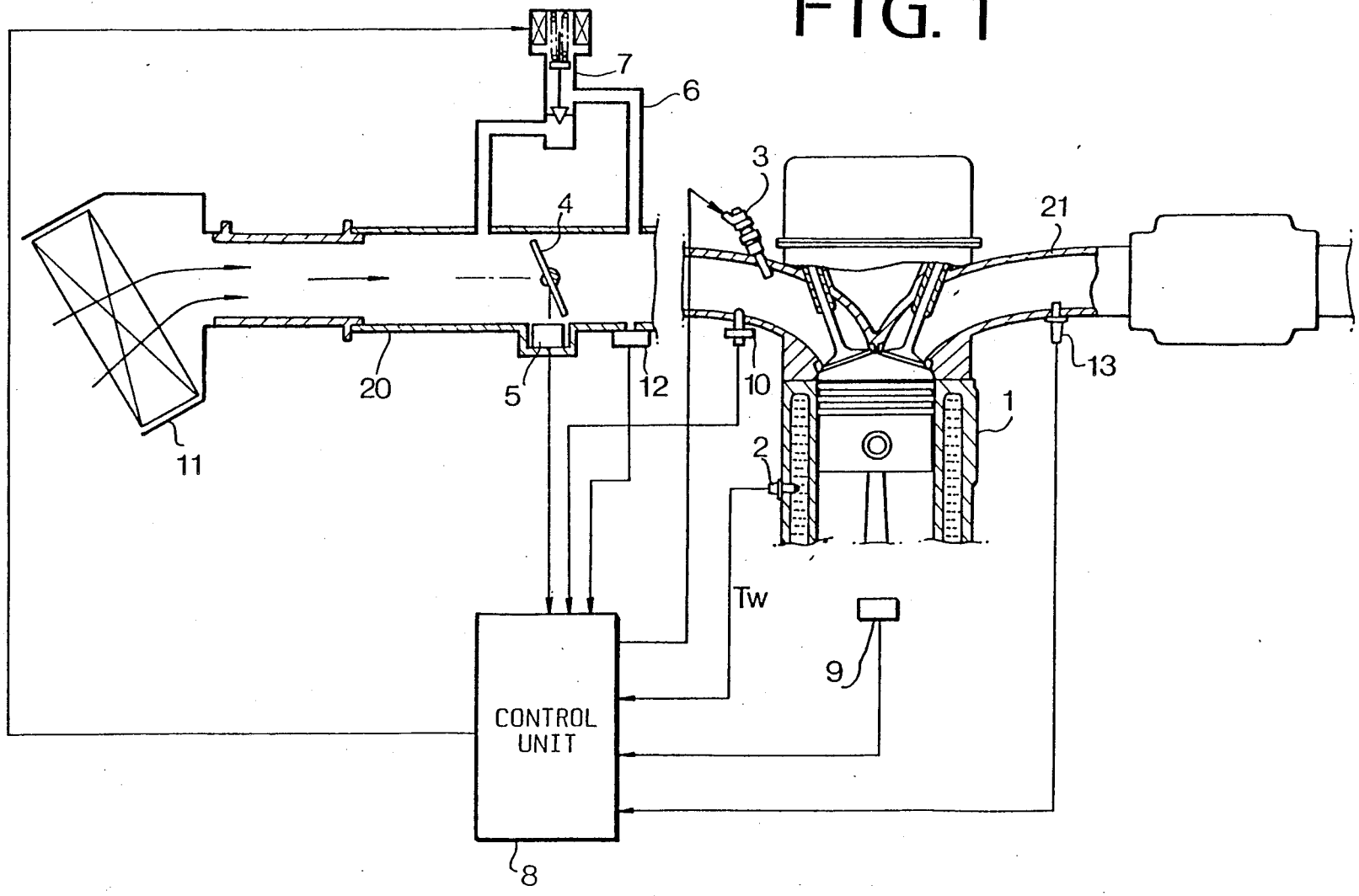
FIG. 1 is a schematic diagram showing a system according to the present invention.

Referring to FIG. 1, an automotive engine 1 is provided with a coolant temperature sensor 2 on a water jacket thereof, a fuel injector 3, and a throttle position sensor 5 for detecting the opening degree of a throttle valve 4 in an intake pipe 20 of the engine. A bypass 6 provided with an idle speed control (ISC) valve 7 is provided around the throttle valve 4. Further, there are provided a crankangle sensor 9 as an engine speed sensor, an air cleaner 11, an intake air temperature sensor 10, a pressure sensor 12 for detecting pressure in the intake pipe 20 downstream of the throttle valve 4, and an $O_2$-sensor 13 for detecting the oxygen concentration of the exhaust gas in an exhaust pipe 21. The output signals of these sensors are fed to a control unit 8 which produces signals for operating the fuel injector 3, and an ISC valve 7.

Figure 2:
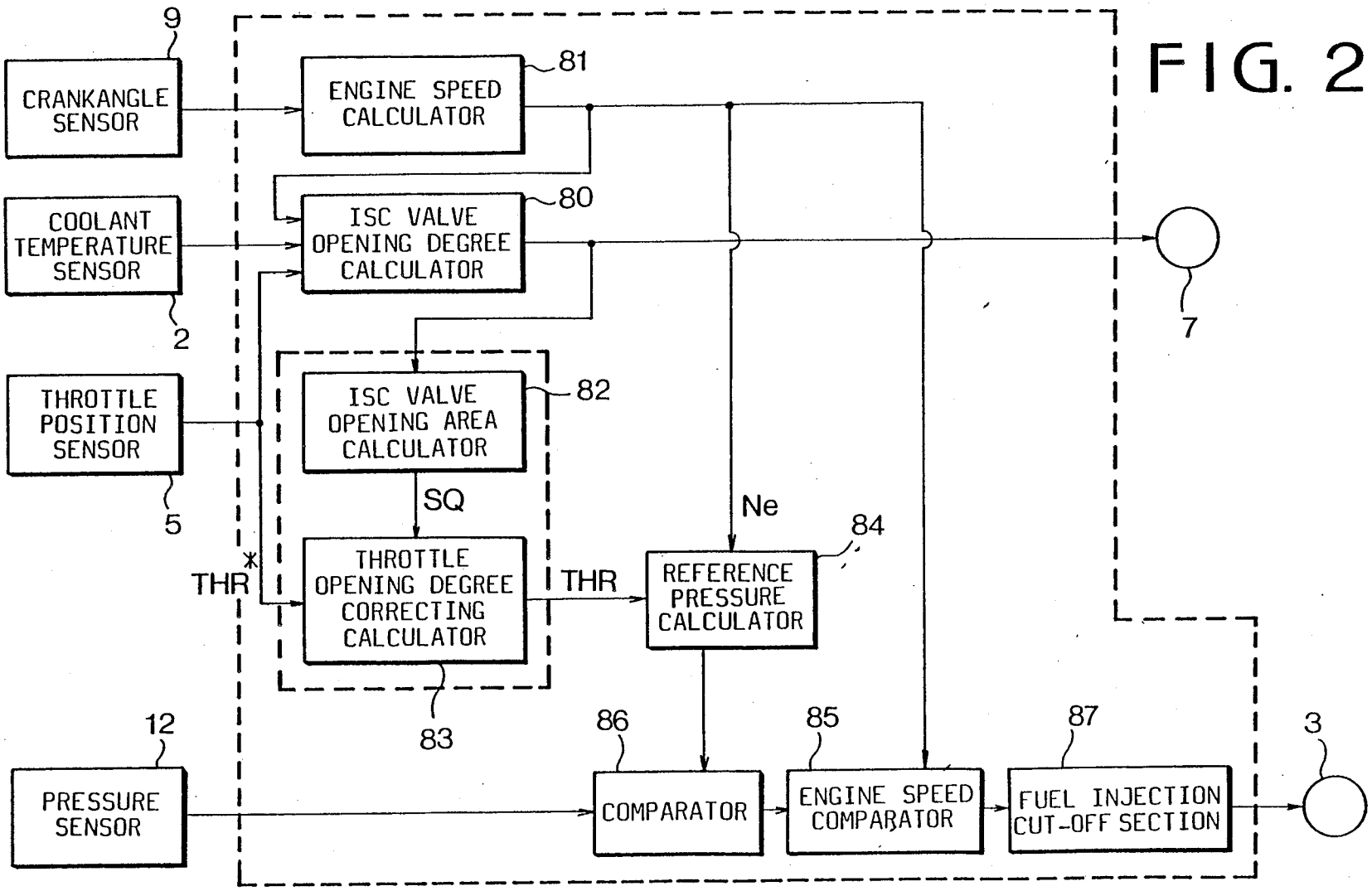
FIG. 2 is a block diagram of a control unit.

Referring to FIG. 2, an engine speed calculator 81 is supplied with the output signal of the crankangle sensor 9 to produce an engine speed signal. The output signals of the coolant temperature sensor 2, the throttle position sensor 5, and the engine speed calculator 81 are fed to an ISC valve opening degree calculator 80. The output signal of the calculator 80 is applied to the ISC valve 7 to provide a proper opening degree. The output signal is also applied to an ISC valve opening area calculator 82 where the area SQ of an opening to be formed is calculated. The opening area SQ and the throttle position THR* from the throttle position sensor 5 are applied to a throttle opening degree correcting calculator 83. The calculator 83 contains a table storing corrected throttle opening degrees in accordance with the throttle position THR* and opening area SQ, and derives throttle opening degrees from the table. A corrected throttle opening degree $THR = f(THR^*, SQ)$ is calculated by an interpolation calculation based on the derived throttle opening degrees when the ISC valve is opened at idling, thereby increasing the amount of intake air.

Figure 4:
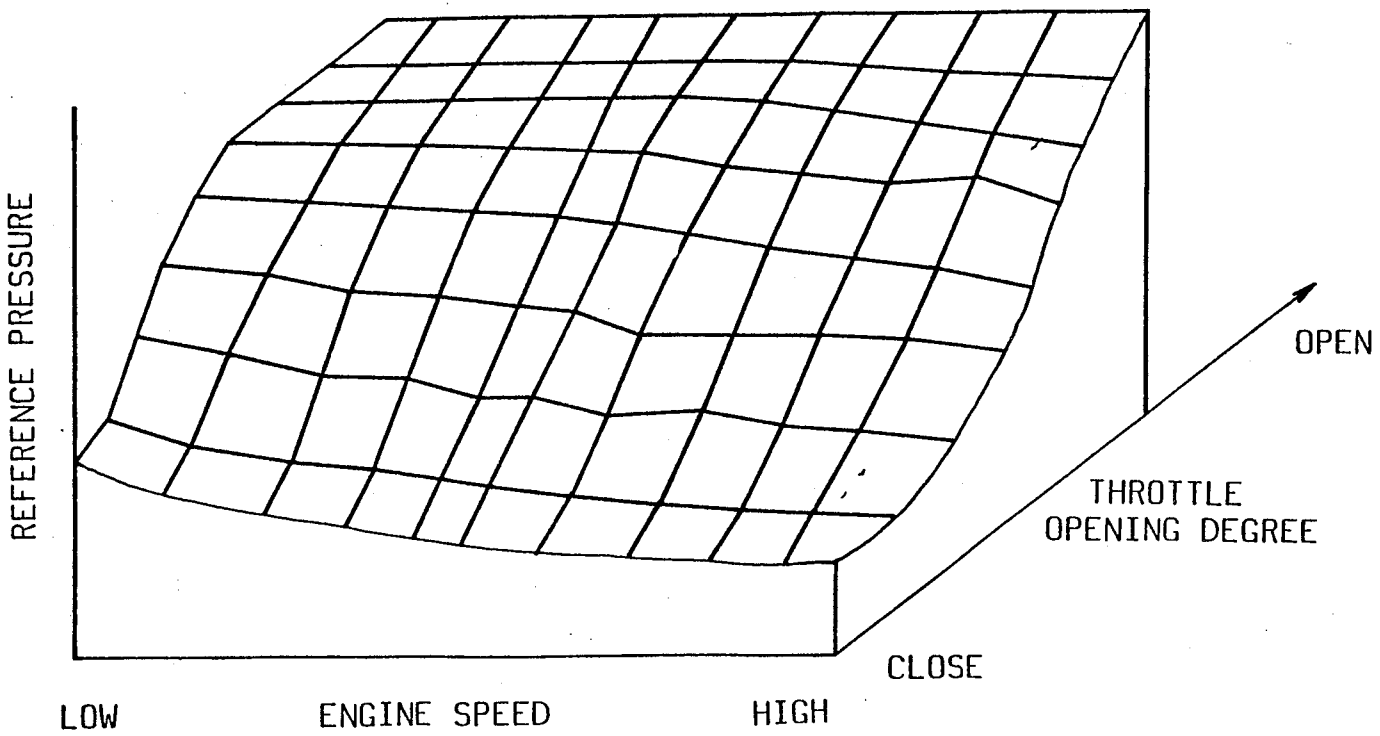
FIG. 4 is a perspective view schematically showing a three-dimensional table.

The output signal Ne of the engine speed calculator 81 and the corrected throttle opening degree THR are sent to a reference pressure calculator 84. The calculator has a three-dimensional table storing reference intake pipe pressure in accordance with engine speed Ne and the corrected throttle opening degree THR, as shown in FIG. 4. In accordance with the engine speed Ne and the corrected throttle opening degree THR, reference pressures are derived from the table. Further, a reference pressure PMR for the pressure in the intake pipe is calculated by an interpolation calculation based on the derived reference pressure PMR=f(Ne, THR). The actual pressure PM detected by the pressure sensor 12 is compared with the corrected reference pressure PMR at a comparator 86. If the corrected reference pressure PMR is higher than the pressure PM in the intake pipe, the intake system is in a normal state. If the pressure PM is higher than the reference pressure PMR, it is determined that there is some trouble in the intake system. The comparator 86 produces a fail-safe signal to maintain a normal operation of the engine accordingly. The fail-safe signal is applied to an engine speed comparator 85 where the engine speed Ne from the engine speed calculator 81 is compared with a predetermined reference engine speed, for example, 1500 rpm. When the engine speed Ne is higher than 1500 rpm, the comparator 85 generates an engine speed reduce signal which is fed to a fuel injection cut-off section 87. An output signal of the cut-off section 87 is applied to the injectors 3 to cut off the fuel.

Figure 3:
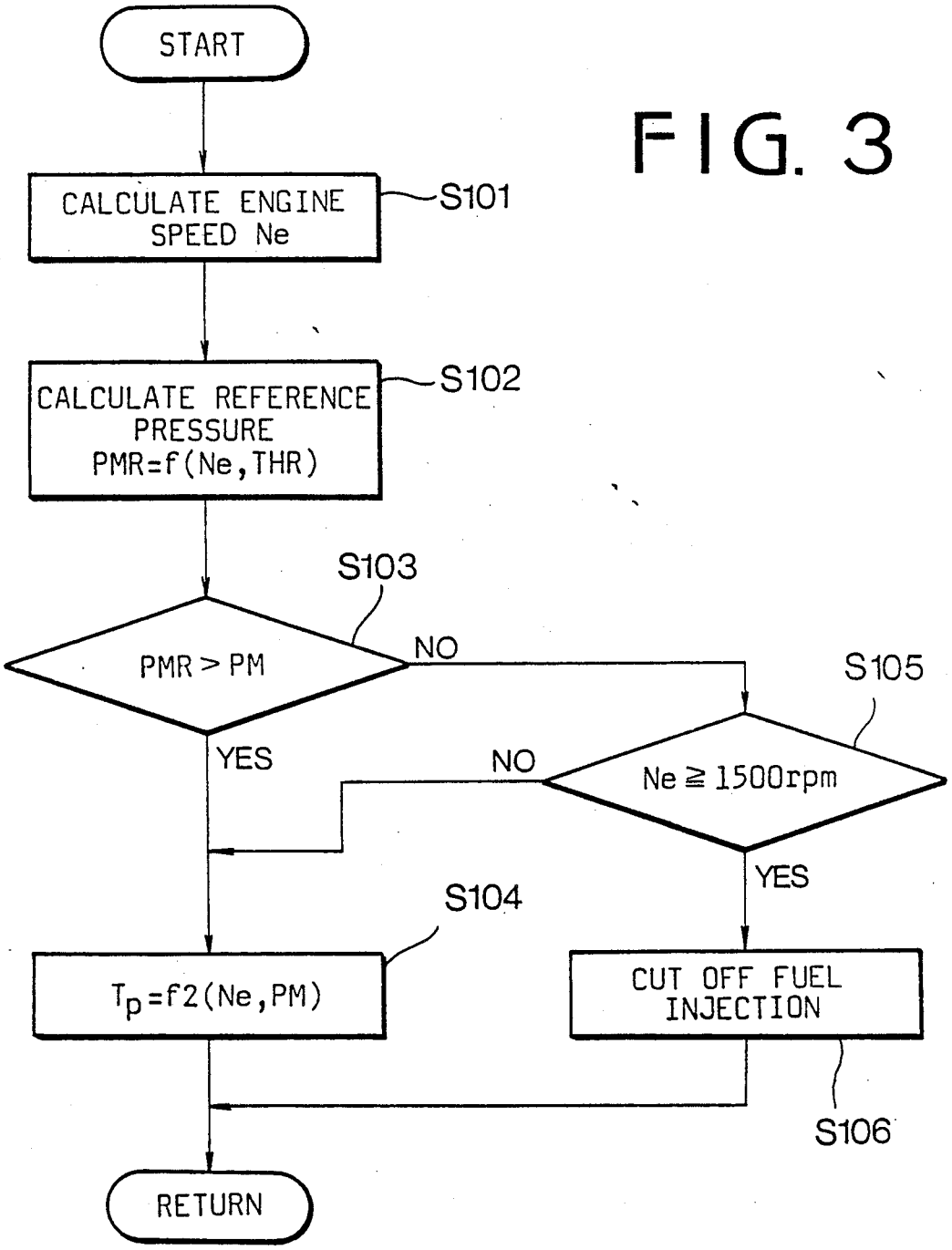
FIG. 3 is a flowchart of the operation of the control unit.

The operation of the system is described hereinafter with reference to FIG. 3. Engine speed Ne, and reference pressure PMR are obtained at steps S101 and S102, respectively. At a step S103, it is determined whether actual pressure PM is higher than the reference pressure PMR or not. If PMR>PM, the program proceeds to a step S104 where a basic fuel injection quantity Tp is calculated in dependency on $Tp=f_2(Ne, PM)$. If PMR<PM, the abnormality occurs in the intake system. It is further determined at a step S105 whether the engine speed Ne is higher than 1500 rpm. If the engine speed Ne is lower than 1500 rpm, the program goes to the step S104. To the contrary, if the engine speed Ne is higher than 1500 rpm, the fuel injection is cut off at a step S106.

Figure 5:
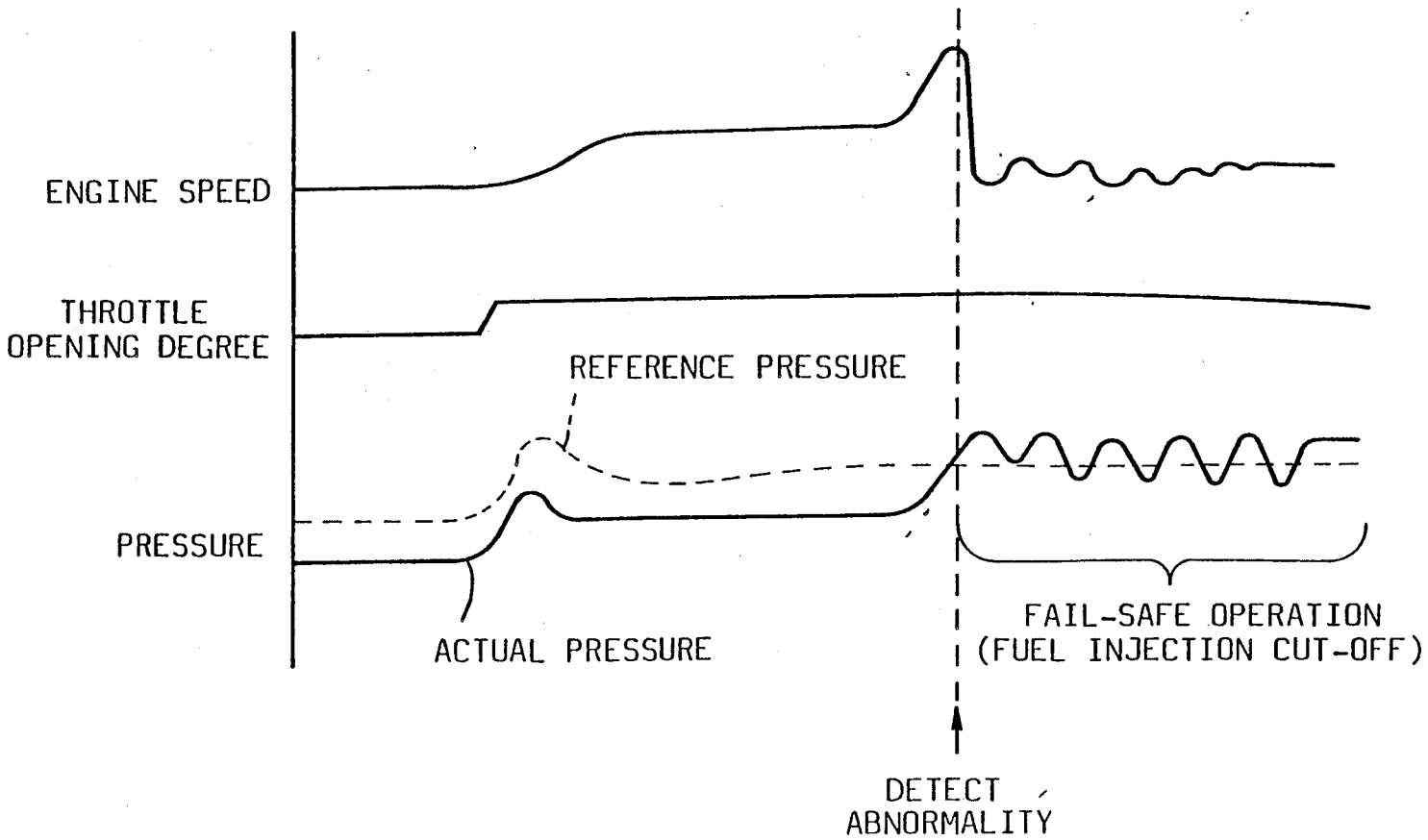
FIG. 5 is a graph showing variations of engine speed, throttle opening degree, reference pressure and actual pressure in an intake pipe.

Referring to FIG. 5, when it is determined that an abnormality occurs in the intake system and that the engine speed is higher than the reference engine speed, the fuel is cut off. When the engine speed falls below the reference speed, the fuel is injected again. Thus, fuel is intermittently injected, thereby keeping the engine speed at a low speed near the reference speed.

In order to detect the opening degree of the throttle valve, a combination of several switches such as an idle switch, a partial open throttle detecting switch and a wide open throttle detecting switch may be employed instead of the throttle position sensor.

An abnormality in the intake system can also be detected through the throttle opening degree or engine speed. More particularly, reference throttle opening degrees are stored in a table having an X-axis representing intake pressure and a Y-axis representing engine speed, and an actual throttle opening degree is compared with a derived reference opening degree. If the intake pressure has an abnormally high value, the derived reference opening degree deviates a lot from the actual opening degree.

From the foregoing, it will be understood that the present invention provides a system where engine speed is maintained under a predetermined speed when an abnormality is detected in an intake system. Accordingly, the motor vehicle is prevented from suddenly starting or from rapidly accelerating. When the engine speed is lower than a predetermined speed, since the basic fuel injection quantity corresponding to the quantity of intake air is applied, the air-fuel mixture does not become excessively lean. Consequently, misfiring of the engine can be prevented. Moreover, in spite of trouble in the intake system, the motor vehicle maintains a minimum driving ability so as to be able to move to the side of the road.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A trouble detecting system for detecting trouble of an intake system of an engine having a fuel supply means for supplying fuel to the engine and engine operating condition detecting means for producing first, second and third parameter signals respectively depending on first, second and third parameters representing engine operation conditions, and said parameter signals at least including an engine speed signal depending on engine speed, the trouble detecting system comprising:

setting means responsive to said first and second parameter signals for setting a reference value and for producing a reference value signal;

comparing means responsive to said reference value signal and said third parameter signal for producing a fail-safe signal when the third parameter exceeds said reference value; and determining means responsive to said fail-safe signal and said engine speed signal for applying a fuel cut signal to said fuel supply means to cut off the fuel whenever said engine speed exceeds a predetermined value, and respectively, for enabling the supplying of the fuel whenever said engine speed falls below said predetermined value, whereby during the trouble said predetermined value prevents a vehicle having said engine from unexpectedly suddenly starting and maintains a minimum driving ability so as to enable moving the vehicle to a safe place.

2. The trouble detecting system according to claim 1, wherein said engine operating condition detecting means comprises an engine speed sensor for producing said engine speed signal, a throttle position sensor for producing a throttle position signal and an intake passage pressure sensor for producing an intake passage pressure signal.

3. The trouble detecting system according to claim 2, wherein said first parameter signal is said engine speed signal, said second parameter signal is said throttle position signal and said third parameter signal is said intake passage pressure signal.

4. The trouble detecting system according to claim 2, wherein said first parameter signal is said intake passage pressure signal, said second parameter signal is said engine speed signal and said third parameter signal is said throttle position signal.

5. The trouble detecting system according to claim 2, wherein said first parameter signal is said throttle position signal, said second parameter signal is said intake passage pressure signal and said third parameter signal is said engine speed signal.

6. A trouble detecting system for detecting trouble of an intake system of an engine having a throttle valve, fuel supply means for supplying fuel to the engine, pressure detecting means for producing a pressure signal depending on pressure in an intake passage of the engine, engine speed detecting means for producing an engine speed signal depending on speed of the engine and throttle position detecting means for producing a throttle position signal depending on opening degree of the throttle valve, the trouble detecting system comprising:

judgement means responsive to said pressure signal, said engine speed signal and said throttle position signal for producing a fail-safe signal when one of said pressure, said engine speed and said opening degree exceeds a reference value set based on the other two of said pressure, said engine speed and said opening degree; and determining means responsive to said fail-safe signal and said engine speed signal for applying a fuel cut signal to said fuel supply means to cut off the fuel whenever said engine speed exceeds a predetermined value, and respectively, for enabling the supplying of the fuel whenever said engine speed falls below said predetermined value, whereby during the trouble said predetermined value prevents a vehicle having said engine from unexpectedly suddenly starting and maintains a minimum driving ability so as to enable moving the vehicle to a safe place.

* * * * *